US006480183B1

(12) United States Patent
Van Ruymbeke et al.

(10) Patent No.: US 6,480,183 B1
(45) Date of Patent: Nov. 12, 2002

(54) DIGITAL JOYSTICK USING CAPACITIVE SENSOR

(75) Inventors: Gilles Van Ruymbeke, Menlo Park, CA (US); Bernard Kasser, Ceyreste (FR); Jean-Philippe Fricker, Mountain View, CA (US); Marc Ledin, Menlo Park, CA (US)

(73) Assignee: Logitech Europe S.A., Fremont, CA (US)

( * ) Notice: Subject to any disclaimer, the term of this patent is extended or adjusted under 35 U.S.C. 154(b) by 0 days.

(21) Appl. No.: 09/360,479

(22) Filed: Jul. 23, 1999

(51) Int. Cl.[7] ..... G09G 5/08
(52) U.S. Cl. ..... 345/161; 324/660
(58) Field of Search ..... 345/158, 160, 345/161; 341/20, 33; 463/38; 324/660

(56) References Cited

U.S. PATENT DOCUMENTS 4,642,595 A 2/1987 Ruumpol ..... 236/135
4,654,576 A 3/1987 Oelsch et al. ..... 322/3
4,685,678 A 8/1987 Frederiksen ..... 273/148 B
4,855,704 A 8/1989 Betz ..... 336/132
4,879,556 A * 11/1989 Duimel ..... 341/20
5,136,286 A * 8/1992 Veneruso ..... 340/870.37
5,421,694 A * 6/1995 Baker et al. ..... 414/694
5,576,704 A * 11/1996 Baker et al. ..... 341/20
5,598,090 A * 1/1997 Baker et al. ..... 322/3
5,687,080 A * 11/1997 Hoyt et al. ..... 700/85
5,689,285 A * 11/1997 Asher ..... 345/161
5,847,694 A * 12/1998 Redford et al. ..... 345/158
5,911,627 A * 6/1999 Piot et al. ..... 463/38
5,949,354 A * 9/1999 Chang ..... 341/33
6,043,806 A * 3/2000 Atwell ..... 345/161
6,184,865 B1 * 3/2000 Zimmerman et al. ..... 345/160
6,115,030 A * 9/2000 Berstis ..... 345/161
6,304,091 B1 * 10/2001 Shahoian et al. ..... 324/662

* cited by examiner

*Primary Examiner*—Steven Saras
*Assistant Examiner*—Uchendu O. Anyaso
(74) *Attorney, Agent, or Firm*—Townsend and Townsend and Crew LLP

(57) ABSTRACT

A joystick that detects position and movement using a capacitive sensor. The joystick has a stick mounted to allow movement within a housing, a conductive element at a first end of the stick, and a capacitive sensor. The capacitive sensor may be a capacitive touchpad. It determines position by measuring the change in capacitance on a set of conductive traces. The capacitive sensor may be shaped as a plane or may be hemispherically-shaped. The conductive element may also be triangular or other distinctive shape to allow detection of movement. An advantage of such a joystick is that absolute positioning may be determined, along with relative positioning.

25 Claims, 5 Drawing Sheets

DIGITAL JOYSTICK USING CAPACITIVE SENSOR

BACKGROUND OF THE INVENTION

The present invention relates generally to input devices for digital systems, and more particularly to a joystick that detects position and motion using a capacitive sensor.

Joysticks are well-known input devices for digital systems such as personal computers, games, hand-held personal organizers, and the like. They are particularly used by the gaming community for controlling the actions of characters or objects within a gaming environment. They are also used in industrial environments for controlling movement of objects or tools. Typically, a joystick may have a stick—usually mounted vertically—for grasping by the user, and one or more buttons for performing various functions. The user moves the joystick in the direction he or she desires an action to occur, and the joystick senses the movement and translates it to signals to be interpreted by the system. In a variation of the joystick, the stick is a stationary microstick mounted on a device, and movement is determined by pressure on the stick in various directions.

Other types of input devices are also commonly used as pointing devices. For example, mice and trackballs have been widely used. An embodiment of these use a light source in conjunction with an optical sensor to determine movement. As the trackball or a ball located on the bottom of a mouse is rotated, encoder disks within the device rotate. The encoder disks have regularly spaced openings through which the light can shine through. By monitoring the light alternatingly turning on and off as the encoder disk rotates, the optical sensor detects the rotation. Movement can thereby be determined. Touchpads are another type of input device. A touchpad determines—by various means such as resistive or capacitive sensing—the movement of a pointing device across its surface.

Many different mechanisms have been used in the past to detect movement of joysticks. One type of joystick uses potentiometers, with movement of the joystick moving a wiper on the potentiometer. Other types of joysticks have included optical, electromagnetic sensing such as Hall-effect sensors, and induction coils. For example, U.S. Pat. Nos. 4,685,678 and 4,855,704 describe induction coil joysticks. Another type of joystick is shown, for example, in U.S. Pat. Nos. 4,879,556 and 4,642,595. They show the use of a transmitter coil in the stick of the joystick, which is surrounded by receiving coils. Another type of design is shown in U.S. Pat. No. 4,654,576 which shows a metal disk attached to the stick with coils mounted on different sides of it. The metal disk has a tapered bottom, and if the joystick is tilted, the disk will come closer to certain coils, changing the inductance.

Joysticks that are currently known suffer from a variety of disadvantages. For example, they depend on mechanical parts that tend to deteriorate over time. They are also subject to variation due to mechanical tolerances. The wires and connections tend to wear out and eventually break with constant movement. In operation, these types of joysticks are not able to detect rotation of the handle and have no way of determining absolute position since they don't have a reference point. Thus, only relative movement can be determined. Further, they often suffer from backlash where the cursor does not return to its original location when the joystick is moved to the opposite side and back to its original point.

SUMMARY OF THE INVENTION

The present invention combines a joystick with a capacitive touchpad for determining position and movement of the joystick. The joystick includes a stick mounted to allow movement, a conductive element at a first end of the stick, and a capacitive touchpad for sensing movement of the stick. The stick is, in effect, a virtual finger moving across the capacitive touchpad. Position and movement of the joystick is determinable by monitoring the capacitance on conductive traces in the capacitive touchpad. The capacitance of a particular conductive trace increases as the conductive element nears that particular conductive trace. A capacitive-type touchpad is advantageous in that it does not use mechanical parts that are subject to wear and deterioration over time. Moreover, the present invention allows for rotation of the stick and absolute positioning to be determined.

In one embodiment of the present invention, the capacitive touchpad is a hemispherically-shaped device. Because of the shape of the capacitive touchpad, as the conductive element moves, it remains equidistant from the capacitive sensor. In another embodiment of the present invention, the capacitive touchpad sensor is planar as in traditional touchpads. A spring may be mounted to the conductive element to allow movement with respect to the stick to keep the conductive element equidistant from the capacitive sensor.

In another embodiment of the present invention, the stick is split into two end sections with a conductive element at both end sections. The relative position of the two end sections may be determined by the capacitive touchpad and rotation of the stick determined therefrom.

In yet another embodiment of the present invention, the shape of the conductive element is used to determine rotation and movement of the joystick relative to a conductive trace. For example, the conductive element may be triangularly shaped. Thus, as the joystick is moved, the surface area of a particular conductive trace covered by the conductive element increases or decreases. By analyzing the change in capacitance, movement or rotation may be determined.

For a further understanding of the nature and advantages of the invention, reference should be made to the following description taken in conjunction with the attached drawings.

DESCRIPTION OF THE SPECIFIC EMBODIMENTS

Figure 1:
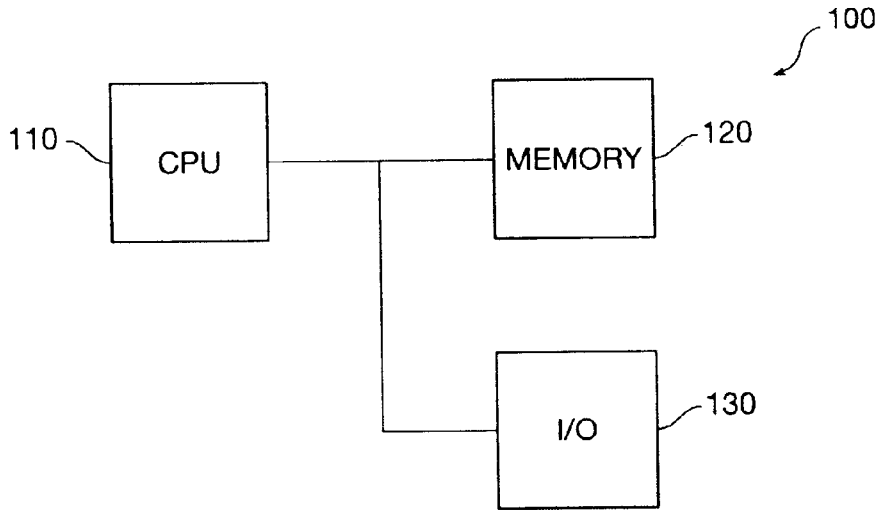
FIG. 1 is block diagram of a digital system 100 within which the present invention may be embodied.

FIG. 1 is block diagram of a digital system 100 within which the present invention may be embodied. Though its inclusion in digital system 100 is depicted herein as a specific embodiment of the present invention, the present invention may also be included in many other types of systems such as analog systems, mechanical systems, and other types of devices. A personal computer is an example of digital system 100, although many other devices such as arcade games, television set-top boxes, mechanical control systems, and the like may readily be envisioned as systems that could incorporate the principles of the present invention. Digital system 100 typically contains a CPU 110, a memory 120, and an input/output device 130. CPU 110 is the main controller of digital system 100 and may be a microprocessor, microcontroller, or other intelligent processing device. Memory 120 is coupled to CPU 110 and provides data storage for programs and data. Input/output device 130 is also coupled to CPU 110 for receiving user input and outputting results. Input/output device 130 may also be coupled to memory 120 for direct memory access. Input/output device 130 may include, for example, the joystick of the present invention.

Digital system 100 may include executable code that is executed by CPU 110. The code may be stored in memory 120. Memory 120 may include semiconductor memory, fixed, or removable storage mediums. Alternatively, the code may be input through input/output device 130. The code may include operating system or application programs and may be written in any of a variety of programming languages.

Figure 2:
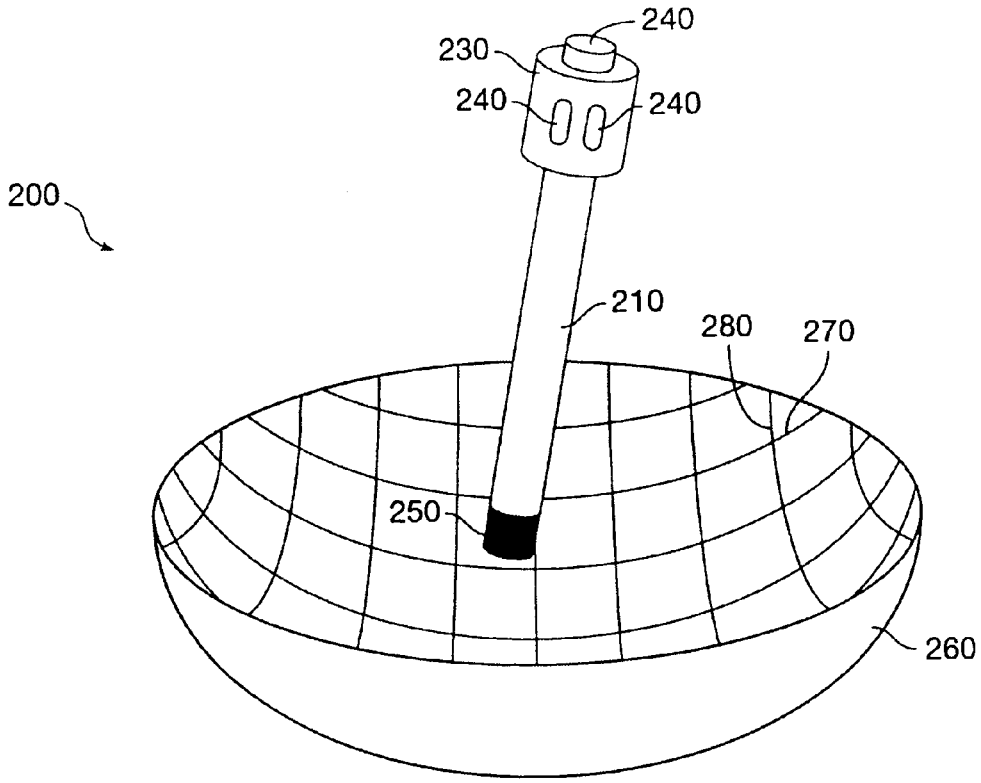
FIG. 2 shows an embodiment of a joystick according to the present invention.

FIG. 2 shows an embodiment of a joystick 200 according the present invention. Joystick 200 includes a stick 210 that is mounted to a housing (not shown) such that it can pivot in any direction. Stick 210 has a grip 230 at or near one of its ends. Grip 230 is preferably designed such that a user can easily grasp it and may be ergonomically designed for the comfort of the user and for maximum efficiency of use. Grip 230 may also include one or more buttons 240 that are conveniently located such that the user can depress them with a finger or thumb easily during operation of joystick 200. Their placement is also preferably designed for ease of use of the user. The housing may also include one or more buttons (not shown) that may also be pressed during operation of joystick 200.

In operation, as the user moves stick 210 by grasping and moving grip 230, the opposite end of stick 210 moves relative to a capacitive sensor 260. Capacitive sensor 260 may be a touchpad. An exemplary touchpad is described, for example, in U.S. patent application Ser. No. 08/582,769, filed Jan. 4, 1996, which is incorporated herein by reference for all purposes. A conductive element 250 is located at or near the opposite end of stick 210. Conductive element 250 may be attached to stick 210, or it may be integrated within stick 210. Alternatively, stick 210 may be made of conductive material. Many types of conductive material may be used for conductive element 250 such as iron or other conductive metals.

Capacitive sensor 260 is included within the housing containing stick 210. In the specific embodiment shown in FIG. 2, capacitive sensor 260 is hemispherically-shaped. Its shape is designed such that as stick 210 moves, conductive element 250 remains equidistant from capacitive sensor 260. Capacitives sensor 260 includes a first plurality of conductive traces in a first direction and a second plurality of conductive traces in a second direction thereby defining a coordinate system. An insulator electrically isolates the first plurality from the second plurality. The first and second plurality of conductive traces may be perpendicularly oriented with respect with each other to form a Cartesian coordinate system with X-traces 270 and Y-traces 280. The conductive traces may also be oriented with a first plurality of sensors of concentrically oriented circles extending outwardly from the center and a second plurality of conductive traces extending radially outwardly from the center forming a polar coordinate system. Other types of coordinate systems may also be envisioned and appropriate conductive traces placed to implement the desired coordinate system.

Capacitive sensor 260 may be formed using thermo shaping (i.e., manufacturing a flat touchpad and then heating and reshaping it to a desired shape). Alternatively, the conductive traces may be printed with conductive ink on a previously formed hemispherically-shaped plastic part.

Figure 3:
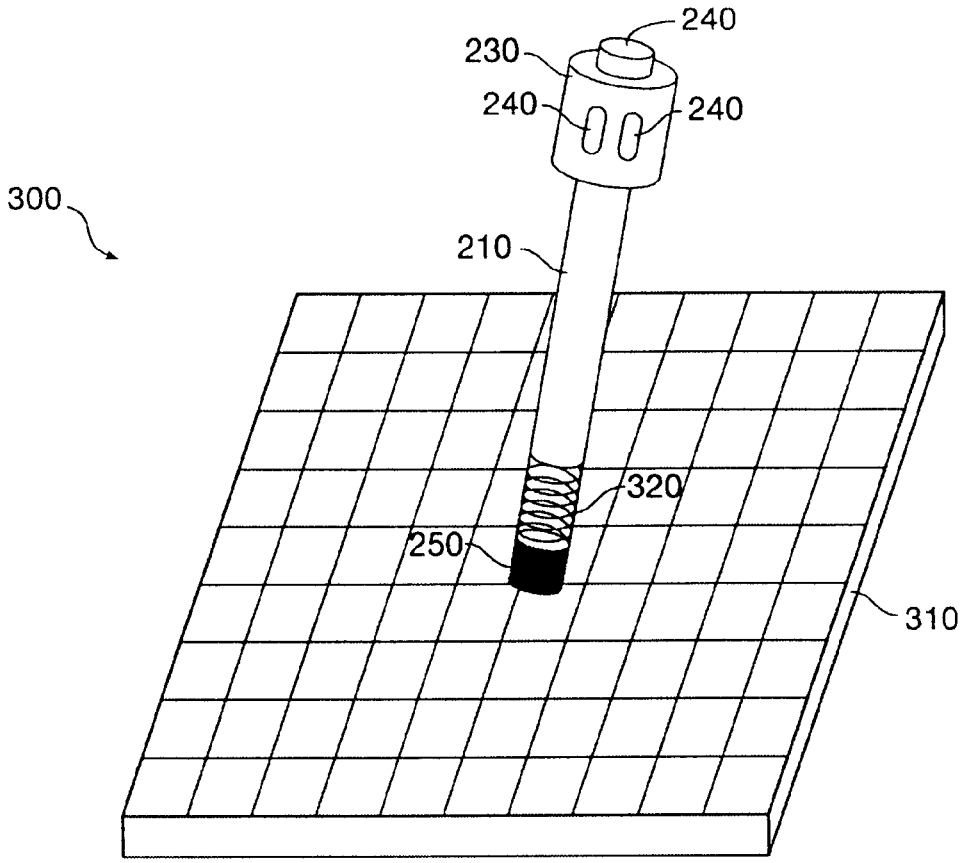
FIG. 3 is another embodiment of a joystick according to the present invention.

FIG. 3 shows a second embodiment of a joystick 300. Joystick 300 differs from joystick 200 in that, rather than a hemispherically-shaped capacitive sensor, it includes a planar capacitive sensor 310. An advantage of a planar capacitive sensor 310 is that it is simpler to manufacture. However, because it is planar, as the user moves stick 210, capacitive element 250 does not move uniformly across capacitive sensor 310. Therefore, equal movement of stick 210 will not cause equal lateral movement across capacitive sensor 310. Also, the distance between capacitive element 250 and capacitive sensor 310 will not remain constant. To adjust for these non-uniformities, a spring 320 may be included between conductive element 250 and stick 210. Spring 320 adjusts conductive element 250 such that it remains equidistant from capacitive sensor 310.

Even with the addition of spring 320, movement of the joystick across the conductive traces is not uniform if the conductive traces are spaced equidistant apart. As conductive element 250 travels away from the center of capacitive sensor 310, it takes more movement of the joystick to move the same absolute distance. Firmware may be used to compensate for this variance since it can be readily calculated as will be recognized by one of skill in the art. Alternatively, the conductive traces in capacitive sensor 310 may be spaced appropriately such that equal movement of conductive element 250 will cause equal displacement with reference to each individual conductive trace.

Figure 4:
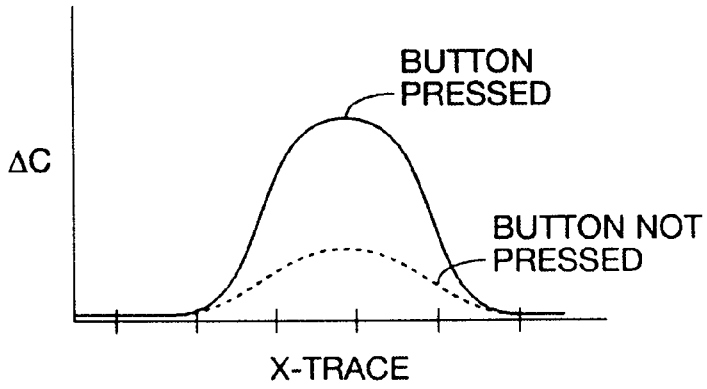
FIG. 4 is a graph showing the difference in capacitance that may be measured when a button is pressed or not pressed.

In an embodiment of the present invention, joystick 200 may also be designed to easily detect whether the user is holding grip 230. A conductive wire (not shown) electrically couples a sensor (not shown) in grip 230 with conductive element 250. The conductive wire is preferably coupled to the sensor by a capacitive electrical connection. When the user is holding grip 230, the user is thereby connected to conductive element 250 through the sensor and conductive wire. This changes the magnitude of the capacitance that is detected on the conductive traces. This same principle may also be used in another embodiment to detect whether button 240 has been pressed. The buttons may be connected to additional conductive material (not shown) such that—when the button is pressed, the additional conductive material is electrically coupled to conductive element 230 and—when the button is not pressed, the additional conductive material is electrically isolated from conductive element 230. The additional material changes the magnitude of the capacitance detected on the conductive traces indicating that a button has been pressed. This is shown graphically in FIG. 4 in which the measured change in capacitance is plotted for each of the X-traces 270. The solid line represents the capacitance change measured when button 240 has been pressed, while the broken line represents the capacitance change measured when button 240 has not been pressed. As indicated in FIG. 4, when button 240 has not been pressed, a certain magnitude of capacitance change is detected and when button 240 has been pressed, while the same profile is detected, the magnitude of the capacitance change is greater due to the additional conductive material.

Figure 5:
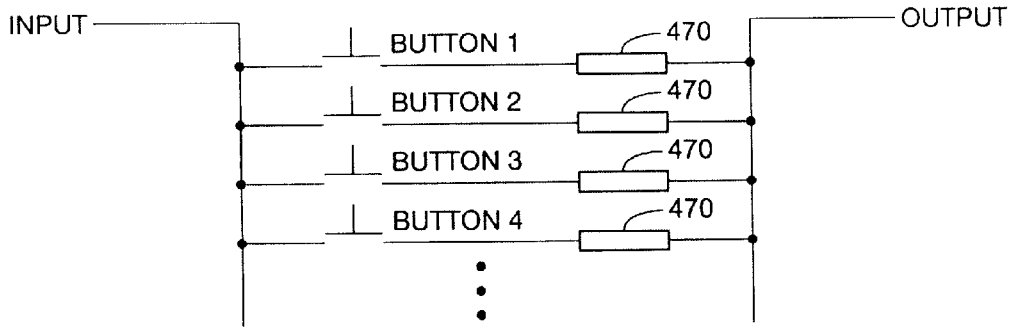
FIG. 5 is a circuit diagram of a structure for detecting the pressing of buttons.

FIG. 5 shows another method by which the pressing of buttons may be detected. An input signal is coupled to an output through one or more buttons. These buttons are momentary switches that selectively couple the input to the output when pressed, although other types of buttons may also be used. An electrical element 470 such as resistance, capacitance, or inductance is coupled in series with each button such that the value for each button is unique. Thus, depending on which button is pressed, the characteristics of the output signal are different. Consequently, by monitoring the output signal, a system can determine whether a button has been pressed and which button it was. For example, a different resistance may be coupled to each button such that a different output voltage is on the output, depending upon which button has been pressed. In a specific embodiment, the input signal comes from an integrated circuit device that provides an oscillating signal on the input and measures the output. The connection between the joystick buttons and the integrated circuit is preferably a capacitive connection since movement of the joystick over time may cause a conventional electrical wire to wear and possibly break. In the specific embodiment, the integrated circuit also performs other functions such as monitoring conductive traces 270 and 280 to determine movement of the joystick.

Figure 6:
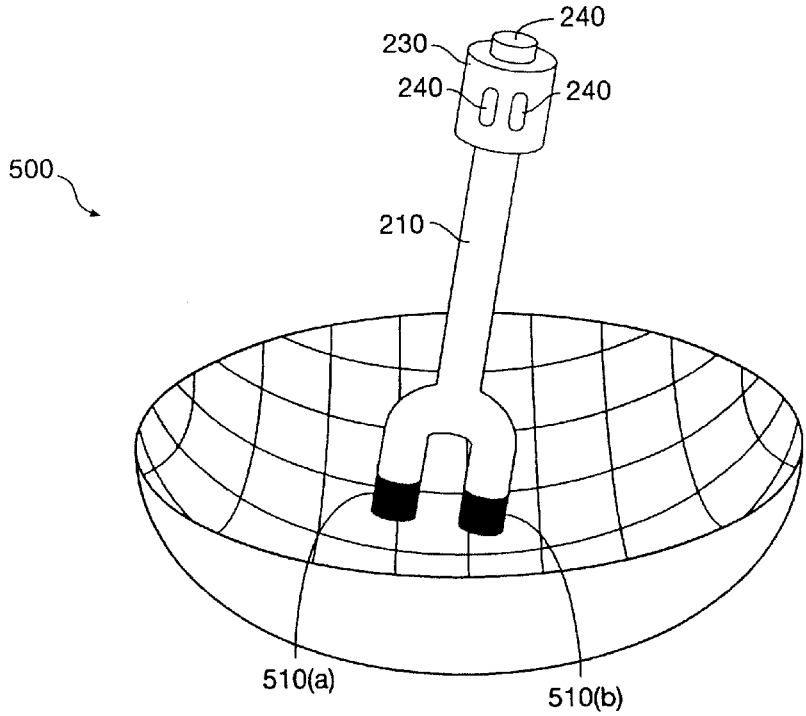
FIG. 6 shows yet another embodiment of a joystick of the present invention.

FIG. 6 shows a joystick 500 that incorporates yet another embodiment of the present invention. In joystick 500, stick 210 is divided at the end opposite grip 230 into two end sections 510(*a*) and 5lO(*b*). Each of the two end sections 510 have a conductive element that affects the measured capacitance on the capacitive elements as described above. An advantage of joystick 500 is that rotation can be detected as well as movement. By noting the relative position of the two conductive elements 510, their orientation with respect to each other can be determined and rotation of joystick 500 detected. Of course, one of skill in the art can readily extend this principle to envision many different configurations and combination of conductive elements at the end of stick 210. Such arrangements are also included in the present invention.

Capacitive sensor 260 may be operated according to existing touchpad operation but the present invention also anticipates that new or improved methods may be used as they are developed. The touchpad described in U.S. patent application Ser. No. 08/582,769 filed Jan. 4, 1996 (which was previously incorporated by reference) may be preferably used. The capacitance on one, two or more traces 270 and 280 may be measured at a time, or all of the traces may be measured simultaneously. In one embodiment, all of the X-traces 270 are sampled simultaneously, followed by all of the Y-traces 280.

In its steady state configuration, the capacitance on each of the traces has a capacitive value based on the stray capacitance between X-traces 270 and the other elements in the system. Together, the capacitances total to a value of $C_0$ referencing the steady state capacitance of an individual trace. When conductive element 250 comes in close proximity to X-traces 270, the capacitance measured on each nearby X-trace 270 is changed because of the presence of conductive element 250. This value, referred to herein as $C_{joystick}$, is measured on each of X-traces 270. The change in capacitance is computed by subtracting $C_{joystick}$-$C_0$. Of course, other methods may be used. For example, the measurements can be done in differential mode.

Figure 7:
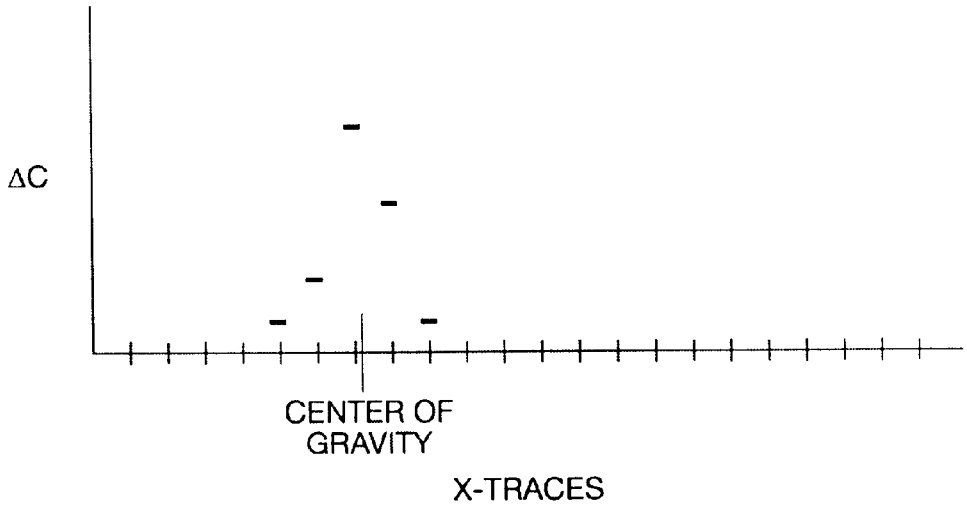
FIG. 7 is a graph of the change in capacitance for each of the plurality of X-traces for an exemplary situation.

FIG. 7 shows a graph of the change in capacitance that may be detected for an exemplary situation. It plots the change in capacitance as determined in the above calculation for each of the plurality of X-traces 270. Because of the relatively large size of conductive element 250, its presence will typically affect the capacitance of more than one X-trace 270. From these data points, the location of joystick 200 may be extrapolated. A preferred method of calculating the location of joystick 200 is by calculating the center of gravity for all the X-traces for which a change in capacitance is measured. The location along the X-axis is the center of gravity. The operation is similarly performed and the center of gravity determined for Y-traces 270 to determine the location along the Y-axis.

Figure 8A:
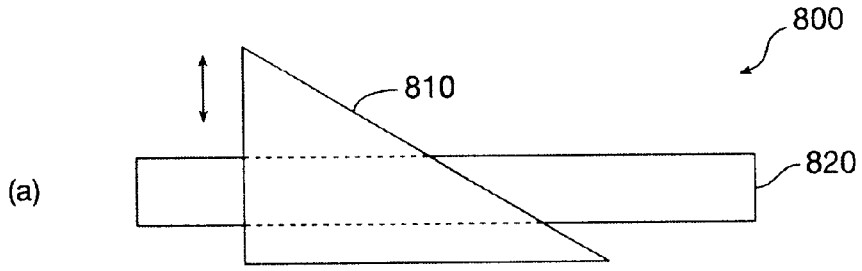
FIGS. 8*a* and 8*b* show embodiments in which the shape of the conductive element may be advantageously used to determine position using the principles of the present invention.
Figure 8B:
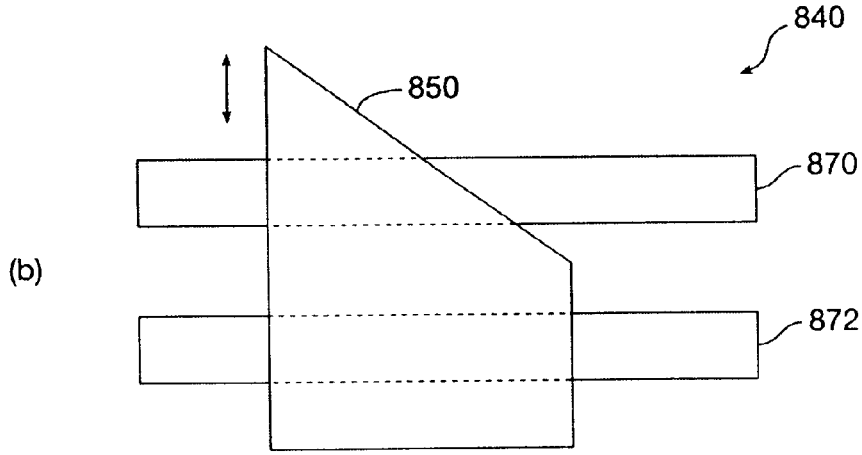
Figure 9A:
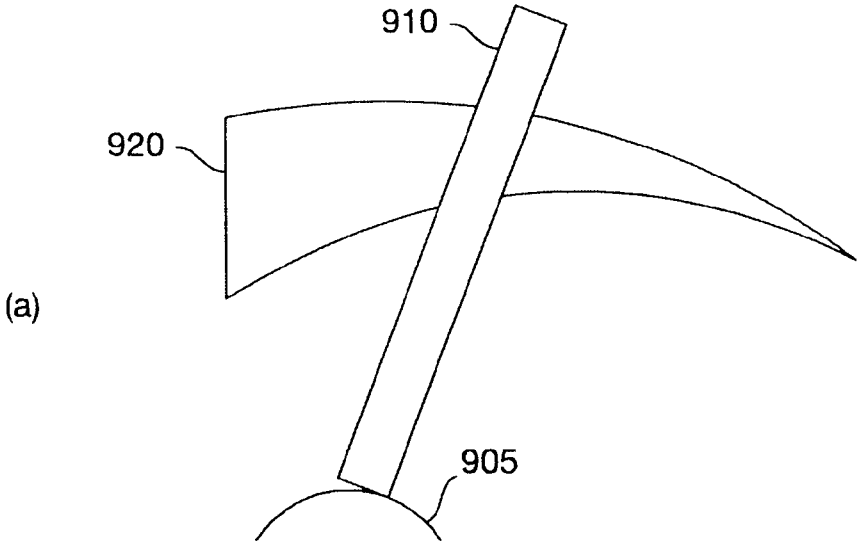
FIGS. 9*a* and 9*b* show embodiments of a twisting joystick or steering wheel using a capacitive sensor that senses rotational movement.
Figure 9B:
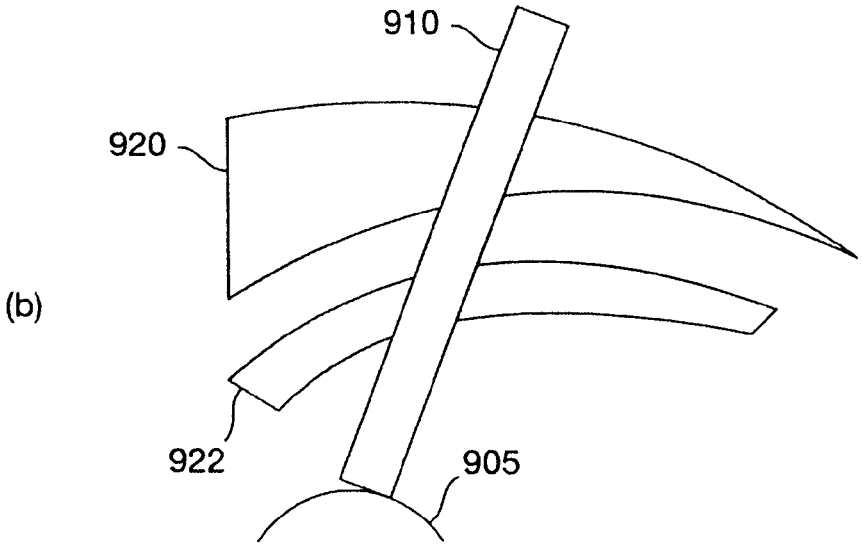

FIGS. 8*a* and 8*b* show another aspect of the present invention by which the shape of a conductive element 810 may be advantageously used to determine position for a joystick 800. In an embodiment shown in FIG. 8*a,* a conductive element 810 is shaped as a triangle but other non-uniform shapes may also be used. The measured change in capacitance along a conductive X-trace 820 will vary depending on the position of triangular conductive element 810 over conductive X-trace 820. Thus, when joystick 800 is moved, the amount of surface area of conductive X-trace 820 changes, thus changing the capacitance measured on conductive X-trace 820. The operation is similar for Y-traces (not shown). An advantage of this type of detection is that fast movement can be quickly determined. Also, the speed of the joystick movement can be determined by calculating the change in capacitance over time, and the acceleration can be FIGS. 9*a* and 9*b* show other embodiments of the present invention. In FIG. 9*a,* a conductive element 910 is coupled to an input device 905. Input device 905 may be, for example, a joystick with a twisting handle or a rotatable input device such as a steering wheel. Conductive element 910 extends across a conductive trace 920 that is shaped such that its cross-section changes in a predictable way. A triangle, or a curved triangle as shown in FIG. 9*a,* are examples of shapes that conductive trace 920 may have, although other shapes will be readily apparent to one of skill in the art. A shape that monotonically increases in cross-sectional distance across is preferable. As input device 905 moves, conductive element 910 moves across conductive trace 920. The capacitance measured on conductive trace 920 is dependent on the cross-sectional area that is covered by conductive element 910. Thus, movement and position of conductive element 910 (and consequently input device 905) can be determined by measuring the capacitance on conductive element 920. FIG. 9*b* shows another embodiment of the present invention that is similar to that of FIG. 9*a* with a second conductive trace 922. A signal is input on second conductive trace 922 and the coupling between trace 920 and 922.

While the above is a complete description of specific embodiments of the invention, various modifications, alternative constructions, and equivalents may be used also. For example, the capacitive elements may take on various sizes and shapes. Also, the capacitive sensor may be substituted with a resistive sensor such as a resistive touchpad. In such a device, the stick would maintain contact with the resistive sensor. Of course, such a device would be more susceptible to wear than the frictionless capacitive sensor. The above description should not be taken as limiting the scope of the invention as defined by the attached claims.

What is claimed is:

1. A joystick comprising:

a stick mounted to allow movement;

a first conductive element toward a first end of the stick; and a spacial capacitive sensor responsive to the conductive element for determining a position of the conductive element, wherein the spacial capacitive sensor is non-planer, and the first conductive element is relatively equidistant from the spacial capacitive sensor throughout its range of motion.

2. The joystick of claim 1 further comprising a plurality of conductive traces in the spacial capacitive sensor, the spacial capacitive sensor being located proximately to the first conductive element such that the position of the conductive element is determinable by measuring the capacitance of the conductive traces.

3. The joystick of claim 1 further comprising:

a second conductive element;

a first prong at the first end of the stick, the first conductive element located on the first prong; and a second prong at the first end of the stick, the second conductive element located on the second prong.

4. The joystick of claim 1 wherein the spacial capacitive sensor is shaped as a hemisphere.

5. The joystick of claim 1 wherein the spacial capacitive sensor is concave.

6. The joystick of claim 1 wherein the first conductive element is integrated in the stick.

7. The joystick of claim 1 further comprising a spring coupling the conductive element to stick.

8. The joystick of claim 1 further comprising a grip located at a second end of the stick.

9. The joystick of claim 2 wherein the conductive traces further comprise:

a first plurality of conductive traces in a first direction:

a second plurality of conductive traces in a second direction; and an insulator separating the first plurality of conductive traces and the second plurality of conductive traces.

10. The joystick of claim 9 wherein the first plurality of conductive traces are perpendicular to the second plurality of conductive traces.

11. The joystick of claim 9 wherein the first plurality of conductive traces are concentric circles extending outwardly from the center of the hemisphere and the second plurality of conductive traces extend radially outwardly from the center of the hemisphere.

12. The joystick of claim 1 further comprising a button for user input.

13. The joystick of claim 12 further comprising additional conductive material that may be selectively coupled to the first conductive element by pressing the button.

14. A digital system comprising:

a CPU;

a memory; and ajoystick comprising:

a stick mounted to allow movement, a first conductive element toward a first end of the stick, a spacial capacitive sensor responsive to the conductive element for determining a position of the conductive element, wherein the spacial capacitive sensor is non-planer, and the first conductive element is relatively equidistant from the spacial capacitive sensor throughout its range of motion.

15. A joystick comprising:

a stick with a first end and a second end, the stick being mounted to allow movement of the first end in a first direction;

a conductive element at a first end of the stick, the conductive element having a shape that is non-uniform in the first direction; and a capacitive sensor having a first conductive trace, the capacitive sensor being responsive to capacitance on the first conductive trace.

16. The joystick of claim 15 wherein the conductive element is triangular.

17. The joystick of claim 15 wherein a cross-section of the conductive element monotonically increases in width in the first direction.

18. The joystick of claim 15 wherein the stick is mounted to allow movement in a second direction and the shape of the conductive element is non-uniform in the second direction, the joystick further comprising a second conductive trace, the capacitive sensor being responsive to capacitance on the second conductive trace.

19. The joystick of claim 18 wherein the second direction is rotation.

20. Ajoystick comprising:

a stick mounted to allow movement, a first end of the stick having a first prong and a second prong;

a first conductive element coupled to the first prong;

a second conductive element coupled to the second prong; and a capacitive sensor responsive to the first and second conductive elements for determining positions of the first and second conductive elements.

21. The joystick of claim 20 further comprising a plurality of conductive traces in the capacitive sensor, the capacitive sensor being located proximately to the first and second conductive elements such that the positions of the first and second conductive elements are determinable by measuring the capacitance of the conductive traces.

22. The joystick of claim 20 wherein the capacitive sensor is shaped as a hemisphere such that as the stick is moved the first and second conductive elements are relatively equidistant from the capacitive sensor throughout the sticks range of motion.

23. The joystick of claim 20 wherein the capacitive sensor is non-planar.

24. The joystick of claim 20 wherein the capacitive sensor is planar.

25. Ajoystick comprising:

a stick mounted to allow movement;

a conductive element toward a first end of the stick; and a spacial capacitive sensor responsive to the conductive element for determining a position of the conductive element, wherein the spacial capacitive sensor is planer; and a spring coupling the conductive element toward the first end of the stick, wherein the spring provides the conductive element remains equidistant from the spacial capacitive sensor.

* * * * *